US005608293A

United States Patent [19]

Blom

[11] Patent Number: 5,608,293

[45] Date of Patent: Mar. 4, 1997

[54] LAMP CIRCUIT ARRANGEMENT FOR CONTROLLING CURRENT FLOW THROUGH SWITCHING ELEMENT

[75] Inventor: Anton C. Blom, Eindhoven, Netherlands

[73] Assignee: U.S. Philips Corporation, New York, N.Y.

[21] Appl. No.: 542,248

[22] Filed: Oct. 12, 1995

[30] Foreign Application Priority Data

Oct. 19, 1994 [EP] European Pat. Off. ..... 94203036

[51] Int. Cl.[6] ..... H05B 37/02

[52] U.S. Cl. ..... 315/219; 315/209 R; 315/224; 315/307; 315/276; 315/DIG. 7

[58] Field of Search ..... 315/209 R, 205, 315/206, 208, 219, 226, 200 R, 224, 307, DIG. 2, DIG. 5, DIG. 7, 274, 276

[56] References Cited

U.S. PATENT DOCUMENTS

| | | | |
|---|---|---|---|
| 4,045,709 | 8/1977 | Morais | 315/205 |
| 4,051,411 | 9/1977 | Knoble et al. | 315/205 |
| 4,766,350 | 8/1988 | Husgon et al. | 315/207 |
| 4,888,524 | 12/1989 | Ganser et al. | 315/200 R |
| 4,928,038 | 5/1990 | Nerone | 315/209 R |
| 5,072,155 | 12/1991 | Sakurai et al. | 315/219 |
| 5,235,255 | 8/1993 | Blom | 315/224 |

*Primary Examiner*—Robert Pascal
*Assistant Examiner*—Haissa Philogene
*Attorney, Agent, or Firm*—Edward Blocker; Bernard Franzblau

[57] ABSTRACT

A circuit for operating a lamp includes supply input terminals for connection to a supply voltage source and a transformer provided with a primary winding L1 and a secondary winding L2. A first branch has terminals (N1,N2) for holding the lamp and connects a first end of the secondary winding L2 to a second end thereof. A second branch comprising a series circuit of a switching element (Q1) and the primary winding L1 interconnects the supply input terminals. A control circuit (SC1) is coupled to a control electrode of the switching element for generating a control signal for rendering the switching element conducting and non-conducting, and thus generating a first current in the primary winding L1 and a second current in the secondary winding L2. The second branch comprises a series arrangement of the primary winding, the switching element (Q1), and the terminals (N1,N2) for connection to the lamp. The total lamp current is controlled via the switching element which passes only a portion of the lamp current.

35 Claims, 3 Drawing Sheets

LAMP CIRCUIT ARRANGEMENT FOR CONTROLLING CURRENT FLOW THROUGH SWITCHING ELEMENT

BACKGROUND OF THE INVENTION

This invention relates to a circuit arrangement for operating a lamp, comprising

- supply input terminals for connection to a supply voltage source,
- a transformer provided with a primary winding L1 and a secondary winding L2,
- a first branch comprising terminals for holding the lamp and connecting a first end of the secondary winding L2 to a second end thereof,
- a second branch comprising a series circuit of a switching element and the primary winding L1 which interconnecting the supply input terminals,
- a control circuit coupled to a control electrode of the switching element for generating a control signal for rendering the switching element conducting and non-conducting, and thus generating a first current in the primary winding L1 and a second current in the secondary winding L2.

Such a circuit arrangement is known from U.S. Pat. No. 5,072,155. In the known circuit arrangement, the lamp is coupled to the secondary winding L2 of the transformer during lamp operation, and the current through the lamp is generated from the second current. The power dissipated by the lamp may be adjusted over a comparatively wide range in that the frequency and/or the duty cycle of the control signal is adjusted. A disadvantage of the known circuit arrangement, however, is that the first current is comparatively great, so that the switching element must be dimensioned for passing a comparatively great current. This renders the known circuit arrangement comparatively expensive.

SUMMARY OF THE INVENTION

An object of the invention is to provide a comparatively inexpensive circuit arrangement with which the power consumed by a lamp operated by the circuit arrangement can be adjusted over a comparatively wide range.

According to the invention, a circuit arrangement as described in the opening paragraph is for this purpose characterized in that the second branch comprises a series arrangement of the terminals for homing the lamp, the primary winding, and the switching element. During lamp operation by means of a circuit arrangement according to the invention, the lamp current is generated from both the first and the second current. The switching element, however, need only be dimensioned for passing the first current. This makes it possible to fit a circuit arrangement according to the invention with a switching element which is capable of passing only a comparatively small current, while nevertheless a comparatively large lamp current can be generated with this circuit arrangement. The effective value of both the first and the second current can be controlled via the frequency and/or duty cycle of the control signal, so that also the effective value of the total current through the lamp can be adjusted over a comparatively wide range via the switching element.

It is often desirable that the first branch is in addition provided with first diode means. The second current flows through these first diode means during lamp operation so that the second current is a direct current in the presence of these first diode means. Depending on the type of lamp operated with the circuit arrangement and on the frequency of the control signal, this rectification is necessary in order to be able to generate part of the lamp current from the second current.

When the supply voltage delivered by the supply voltage source is a low-frequency AC voltage, it is advantageous to include a diode bridge in the circuit arrangement whose input terminals are coupled to one of the terminals for holding the lamp and to a supply input terminal, respectively, and whose output terminals are coupled to a main electrode of the switching element and to an end of the primary winding L1, respectively. It is achieved thereby that the first current is a direct current during lamp operation. This is often necessary because the first current flows through the switching element which is often capable of passing current in one direction only. The portion of the lamp current generated from the first current changes polarity with the same frequency as the supply voltage. Such a low-frequency polarity change is useful in some lamps, for example, for counteracting the occurrence of cataphoresis. In other lamps, this low-frequency polarity change makes possible a comparatively simple electrode construction because each of the electrodes alternately acts as the anode and as the cathode. In order for the portion of the lamp current generated from the second current to have the same polarity as the portion of the lamp current generated from the first current, it is advantageous that the circuit arrangement is, in addition, provided with

- a secondary winding L3 forming part of the transformer,
- a third branch comprising the terminals for holding the lamp and second diode means, and connecting a first end of the secondary winding L3 to a second end,
- switching means which form part of both the first and the third branch,
- control means coupled to a control electrode of the switching means for adjusting the conductivity state of the switching means at each change in polarity of a portion of the lamp current generated from the first current such that only one of the secondary windings is conductively connected to the terminals for holding the lamp.

A circuit arrangement provided with these means is capable of achieving that the portion of the lamp current generated from the second current always has the same polarity as the portion of the lamp current generated from the first current. It is especially advantageous when the control means are formed by the first current. Since the control means need not be provided in the circuit arrangement in the form of a separate circuit component, but are formed by the first current, the circuit arrangement can be of a comparatively simple construction and therefore comparatively inexpensive.

The discharge arc of some discharge lamps, more in particular high-pressure discharge lamps, may exhibit instabilities when the lamp current comprises a high-frequency component. In a circuit arrangement according to the invention for operating such a lamp, it is advantageous that the circuit arrangement is provided with a filter for filtering high-frequency components from the current through the lamp.

It was found that favourable results are obtained when the switching element, the transformer, and the diode means form pan of a DC—DC converter of the flyback type.

It was also found that it is advantageous to dimension the transformer such that the number of rams of each secondary winding accounts for 30%–70% of the number of rams of the primary winding. Preferably, the number of turns of each of the secondary windings is chosen to be approximately equal to the number of turns of the primary winding L1. It was found that this provides an advantageous dimensioning of the other components from which the circuit arrangement is built up.

Since it is possible to adjust the power consumed by the lamp by means of the frequency and/or duty cycle of the control signal, the circuit arrangement may be provided, if so desired, with a control loop coupled to the control circuit for controlling the power dissipated by the lamp.

It was found for the case in which the circuit arrangement comprises first and possibly second diode means that a comparatively small amount of power was dissipated in these diode means when the circuit arrangement is dimensioned such that the control signal renders the switching element conducting when the second current is zero.

BRIEF DESCRIPTION OF THE DRAWINGS

The invention will be explained in more detail with reference to a drawing, in which.

DETAILED DESCRIPTION OF THE EMBODIMENTS

Figure 1:
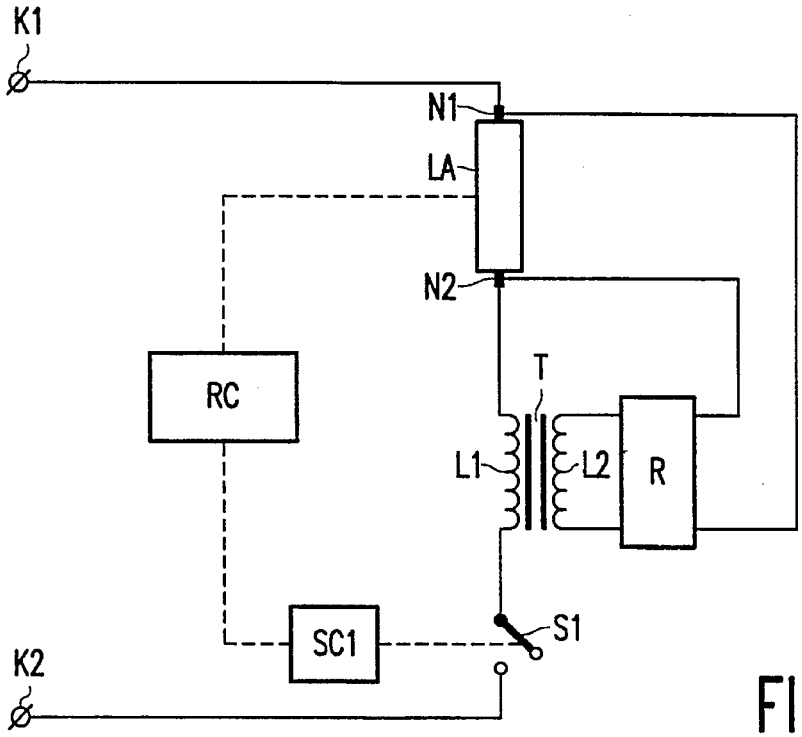
FIGS. 1, 2 and 3 show embodiments of a circuit arrangement according to the invention.

In FIG. 1, K1 and K2 are supply input terminals for connection to a supply voltage source T is a transformer having a primary winding L1 and a secondary winding L2. Circuit portion R and terminals N1 and N2 for holding a lamp together form a first branch which connects a first end of secondary winding L2 to a second end thereof. Circuit portion R comprises all components except the terminals N1 and N2, which form a part of the first branch. Circuit portion R may comprise, for example, diode means and/or capacitive means. A lamp La is connected to the terminals N1 and N2. A series arrangement of the terminals N1 and N2, primary winding L1, and switching element S 1 forms a second branch which interconnects the supply input terminals. A control electrode of the switching element S1 is coupled to a control circuit SC1 for generating a control signal for rendering the switching element conducting and non-conducting, and thus generating a first current in the primary winding L1 and a second current in the secondary winding L2. The coupling between the control circuit SC 1 and the switching element is indicated in FIG. 1 with a broken line. An input of control circuit SC 1 is coupled to an output of circuit portion RC and an input of circuit portion RC is coupled to the lamp. These two couplings are indicated in FIG. 1 with broken lines.

The operation of the circuit arrangement shown in FIG. 1 is as follows.

When the supply input terminals are connected to the poles of a supply voltage source, the control circuit SC1 renders the switching element S1 alternately conducting and non-conducting. As a result, a first current flows through the second branch. At the same time, a second current flows through the first branch. Both the first and the second current flow through the lamp La. The effective value of the first current as well as that of the second current is adjustable by means of the duty cycle and/or the frequency of the control signal generated by the control circuit. The effective value of the total lamp current is accordingly adjustable via the switching element S1 which itself only passes the first current. It is achieved thereby that the lamp current is adjustable over a comparatively wide range by means of a switching element which passes only a portion of the lamp current, and which accordingly need comply with comparatively low requirements as to its dimensioning. A signal which is a measure of the power dissipated by the lamp La is present at the input of circuit portion RC coupled to the lamp La during lamp operation. The circuit portion RC controls the power dissipated by the lamp La through adjustment of the duty cycle and/or the frequency of the control signal via control circuit SC1 such that this power is substantially equal to a desired value of the power to be dissipated by the lamp. Circuit portion RC may also be provided with means (not shown in FIG. 1 ) for adjusting the desired value of the lamp power.

Figure 2:
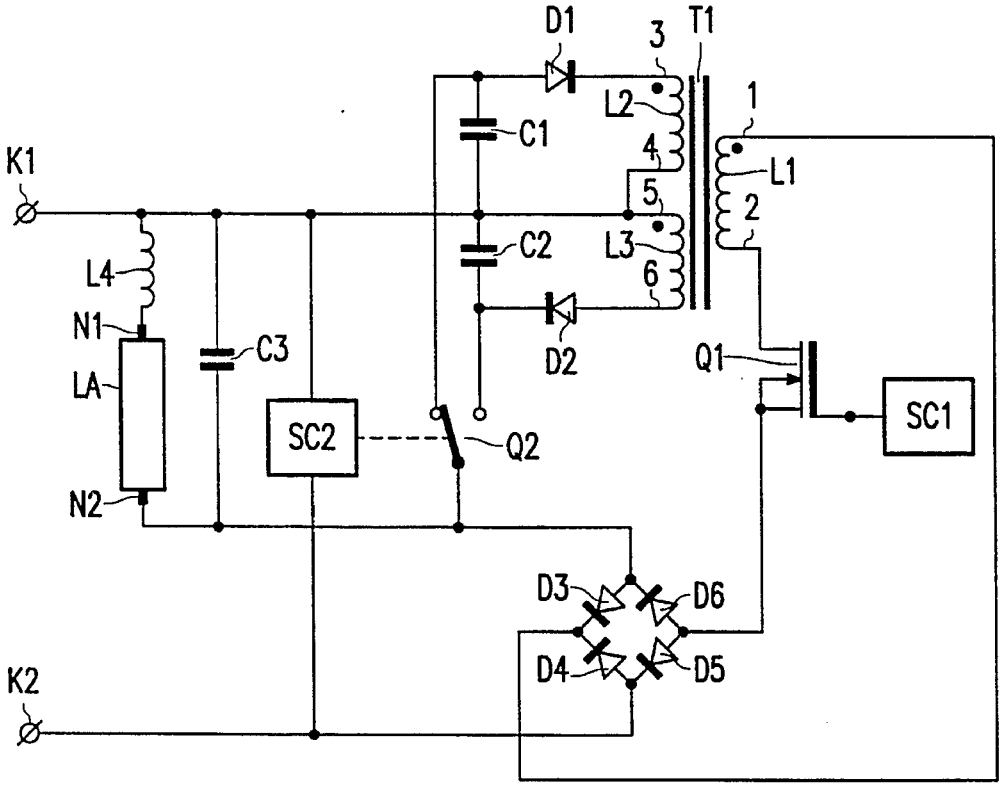

The circuit arrangement shown in FIG. 2 is suitable for being supplied from a low-frequency AC voltage. In FIG. 2, K1 and K2 are supply input terminals for connection to a supply voltage source. T1 is a transformer having a primary winding L1 and secondary windings L2 and L3. Coil LA and capacitor C3 form a filter for filtering high-frequency components from the current through the lamp. The first branch in this embodiment is formed by diode D1, capacitor C1, coil L4, terminals N1 and N2 for holding a lamp, and switching means Q2. Diode D1 forms first diode means. The third branch is formed by diode D2, capacitor C2, switching means Q2, coil IA, capacitor C3, and terminals N1 and N2. Diode D2 forms second diode means. Capacitors C 1 and C2 serve as buffer capacitors and also as high-frequency filters. Circuit portion SC2 forms control means coupled to the switching means Q2 for regulating the conduction state of the switching means. The coupling between circuit portion SC2 and the switching means Q2 is indicated in FIG. 2 with a broken line. The second branch is formed by the coil L4, capacitor C3, terminals N1 and N2, a diode bridge formed by diodes D3–D6, switching element Q1, and primary winding L1. Circuit portion SC1 is connected to a control electrode of the switching element Q1. Circuit portion SC1 forms a control circuit for generating a control signal for rendering the switching element conducting and non-conducting.

Supply input terminal K1 is connected to a first end of coil L4. A further end of coil L4 is connected to terminal N1. A lamp La connected to the terminals N1 and N2 connects terminal N2 to terminal N1. Capacitor C3 connects the first end of coil L4 to terminal N2. Terminal N2 is connected to a first input terminal of the diode bridge. A further input terminal of the diode bridge is connected to supply input terminal K2. A first output terminal of the diode bridge is connected to a first main electrode of the switching element Q1. A further main electrode of the switching element Q1 is connected to a first end of primary winding L1. A further end of primary winding L1 is connected to a further output terminal of the diode bridge. A first end of secondary winding L2 is connected to supply input terminal K1, to a first end of secondary winding L3, and to a first side of capacitor C1. A further side of capacitor C1 is connected to an anode of diode D1 and to a first main electrode of switching means Q2. A cathode of diode D1 is connected to a further end of secondary winding L2. A further end of secondary winding L3 is connected to an anode of diode D2. A cathode of diode D2 is connected to a first side of capacitor C2 and to a second main electrode of the switching means Q2. A further side of capacitor C2 is connected to the first end of secondary winding L3. A third main electrode of switching means Q2 is connected to terminal N2. Inputs of circuit portion SC2 are coupled to supply input terminal K1 and supply input terminal K2, respectively.

The operation of the circuit arrangement shown in FIG. 2 is as follows.

When the supply input terminals K1 and K2 are connected to the poles of a supply voltage source which supplies a low-frequency AC voltage, the switching element Q1 is rendered alternately conducting and non-conducting by the control circuit SC1. As a result, a first current flows in the primary winding. During the half cycles of the low-frequency supply voltage in which the potential applied to supply input terminal K1 is higher than that applied to supply input terminal K2, this first current flows from supply input terminal K1 through coil L4, terminals N1 and N2, lamp La, capacitor C3, diode D3, primary winding L1, switching element Q1, and diode D5 to supply input terminal K2. At the same time, circuit portion SC2 keeps the switching means Q2 in a first state in which the first main electrode of the switching means Q2 is conductively connected to the third main electrode. As a result, a second current can flow from the first end of secondary winding L2 through coil L4, terminals N1 and N2, lamp La, capacitor C3, switching means Q2, and diode D1 to the further end of secondary winding L2. The second and the third main electrode of switching means Q2 are not conductively interconnected in the first state of switching means Q2 so that no current can flow from the further end of secondary winding L3 to the first end of secondary winding L3. It is achieved thereby that the portion of the lamp current generated by the first current flows through the lamp in the same direction as the portion of the lamp current generated by the second current. During the half cycles of the low-frequency supply voltage in which the potential of supply input terminal K2 is higher than the potential of supply input terminal K1, the first current flows from supply input terminal K2 through diode D4, primary winding L1, switching element Q1, diode D6, terminals N1 and N2, lamp La, coil L4, and capacitor C3 to supply input terminal K1. At the same time, circuit portion SC2 keeps the switching means Q2 in a second state in which the second main electrode of the switching means Q2 is conductively connected to the third main electrode. As a result, a second current can flow from the further end of secondary winding L3 through diode D2, switching means Q2, terminals N1 and N2, lamp La, coil L4, and capacitor C3 to the first end of secondary winding L3. The first and the second main electrode of switching means Q2 are not conductively interconnected in the second state of switching means Q2, so that no current can flow from the first end of secondary winding L2 to the further end of secondary winding L2. It is achieved thereby that the portion of the lamp current generated by the first current flows through the lamp in the same direction as the portion of the lamp current generated by the second current also during the half cycles of the low-frequency supply voltage in which the potential of supply input terminal K2 is higher than the potential of supply input terminal K1. The total lamp current generated from the first and the second current is a low-frequency alternating current with a frequency equal to that of the low-frequency supply voltage.

Figure 3:
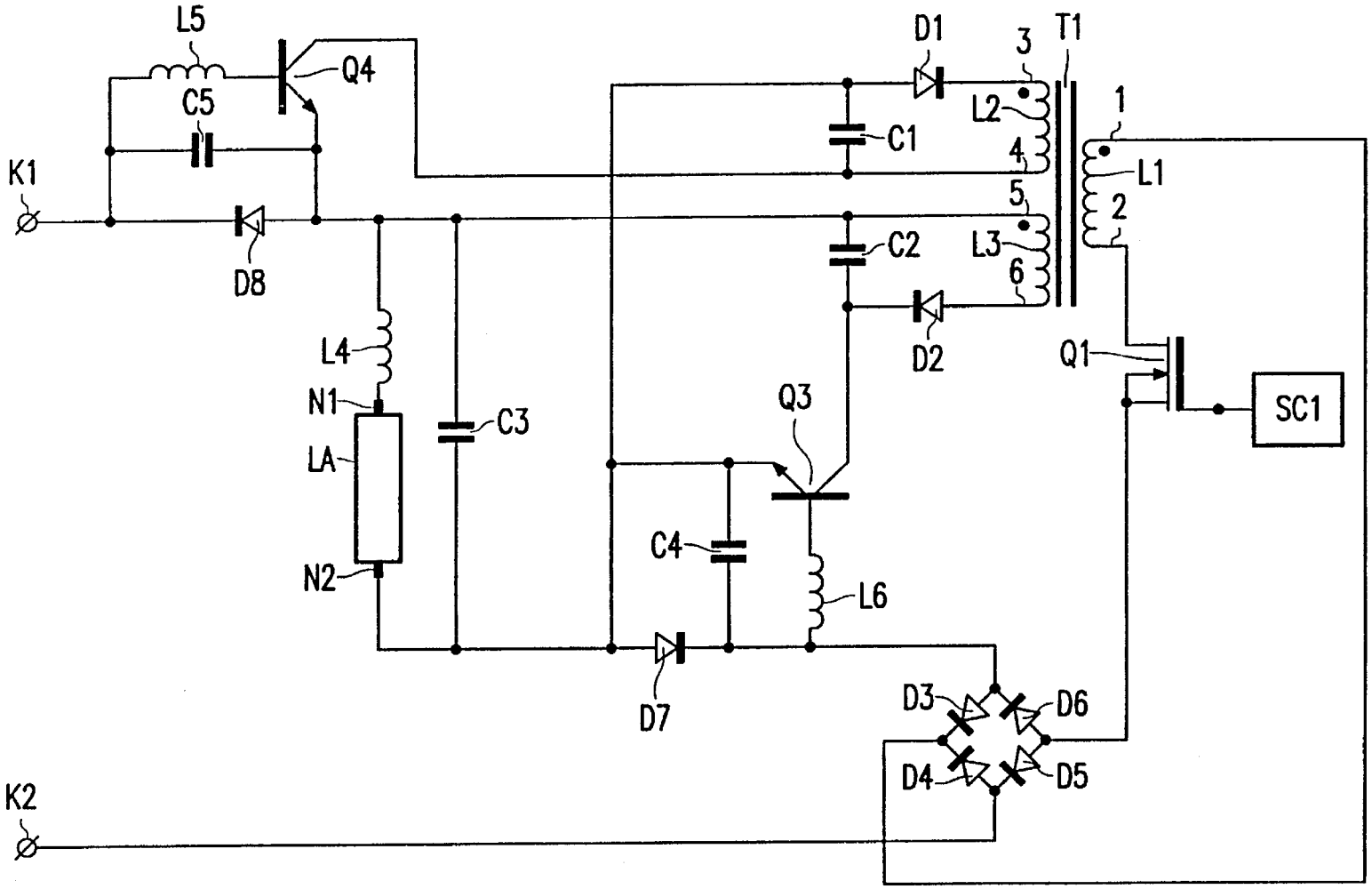

The circuit arrangement shown in FIG. 3 is suitable, as is the circuit arrangement shown in FIG. 2, for being supplied from a low-frequency AC voltage. Components and circuit portions corresponding to components and circuit portions of the circuit arrangement shown in FIG. 2 have been given the same symbols in FIG. 3. Circuit portion SC2 is absent in the circuit arrangement shown in FIG. 3. The switching means Q2 in this embodiment are built up from bipolar transistors Q3 and Q4, diodes D7, D8, coils L5 and L6, and capacitors C4 and C5. Coil L5 and capacitor C5 form a filter for filtering the base-emitter current of bipolar transistor Q4, and coil L6 and capacitor C4 perform the same function for bipolar transistor Q3. The other parts of the circuit arrangement correspond to those in the circuit arrangement shown in FIG. 2.

A first end of coil L5 is connected to a first side of capacitor C5, to a cathode of diode D8, and to supply input terminal K1. A further end of coil L5 is connected to a base of bipolar transistor Q4. An emitter of bipolar transistor Q4 is connected to a further side of capacitor C5, to an anode of diode D8, to the first end of coil L4, to the further side of capacitor C2, and to the first end of secondary winding L3. A collector of bipolar transistor Q4 is connected to the first side of capacitor C1 and to the first end of secondary winding L2. The further side of capacitor C1 is connected to terminal N2. A first end of coil L6 is connected to the first input terminal of the diode bridge, to a cathode of diode D7, and to a first side of capacitor C4. An anode of diode D7 is connected to terminal N2, to a further side of capacitor C4, and to an emitter of bipolar transistor Q3. A further end of coil L6 is connected to a base of bipolar transistor Q3. A collector of bipolar transistor Q3 is connected to the first side of capacitor C2. The construction of the circuit arrangement shown in FIG. 3 corresponds to that of the circuit arrangement shown in FIG. 2 in all other respects.

The operation of the circuit arrangement shown in FIG. 3 is as follows.

When poles of a supply voltage source delivering a low-frequency AC voltage are connected to supply input terminals K1 and K2, the switching element Q1 is rendered conducting and non-conducting alternately by the control circuit SC1. As a result, a first current flows in the primary winding. During the half cycles of the low-frequency supply voltage during which the potential at supply input terminal K1 is higher than that at supply input terminal K2, this first current flows from supply input terminal K1 through capacitor C5, coil L5, the base-emitter junction of bipolar transistor Q4, coil L4, terminals N1 and N2, lamp La, capacitor C3, diode D7, capacitor C4, diode D3, primary winding L1, switching element Q1, and diode D5 to supply input terminal K2. Since the base-emitter junction of transistor Q4 passes current, Q4 is conducting and the second current can flow from the first end of secondary winding L2 through the collector of bipolar transistor Q4, the emitter of bipolar transistor Q4, coil L4, terminals N1 and N2, lamp La, capacitor C3, and diode D1 to the further end of secondary winding L2. The base-emitter junction of transistor Q3 does not pass current, so that transistor Q3 is non-conducting and no current can flow from the further end of secondary winding L3 to the first end of secondary winding L3. During the half cycles of the low-frequency supply voltage in which the potential at supply input terminal K2 is higher than the potential at supply input terminal K1, the first current flows from supply input terminal K2 through diode D4, primary winding L1, switching element Q1, diode D6, coil L6, the base-emitter junction of transistor Q3, capacitor C4, terminals N1 and N2, lamp La, coil L4, capacitor C3, diode D8, and capacitor C5 to supply input terminal K1. Since the bease-emitter junction of transistor Q3 passes current, Q3 is conducting and the second current can flow from the further end of secondary winding L3 through diode D2, the collector of transistor Q3, the emitter of transistor Q3, terminals N1 and N2, lamp La, coil L4, and capacitor C3 to the first end of secondary winding L3. The base-emitter junction of transistor 04 does not pass current, so that transistor Q4 is non-conducting and no current can flow from the first end of secondary winding L2 to the further end of secondary winding L2. The state of the switching means Q2 (i.e., Q3 and Q4) in the circuit arrangement of FIG. 3 is determined by the direction of the current drawn from the supply voltage source. No separate control means are accordingly necessary for this, so that the circuit arrangement shown in FIG. 3 is comparatively cheap.

In FIG. 4, time is plotted in arbitrary units along the horizontal axes of the systems of coordinates shown. Voltage is plotted in arbitrary units on the vertical axis of FIG. 4*a*, and current in arbitrary units on the vertical axes of FIGS. 4*b*, 4*c*, 4*d* and 4*e*. FIG. 4*a* shows the amplitude of a low-frequency supply voltage present between supply input terminals K1 and K2 of the circuit arrangement shown in FIG. 3. This voltage is sinusoidal in the example shown in FIG. 4*a*.

Figure 4A:
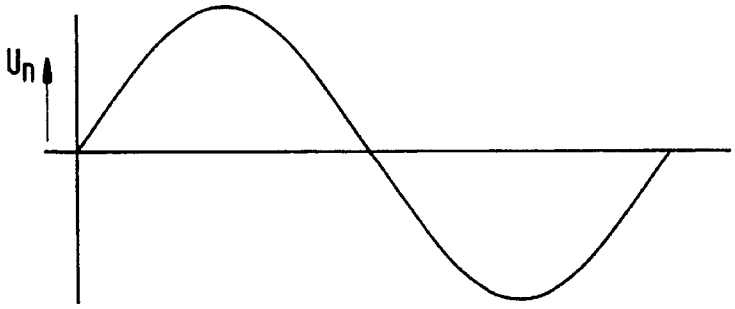
FIG. 4*a–e* show the waveforms of currents and voltages which occur during lamp operation with a circuit arrangement as shown in FIG. 3.
Figure 4B:
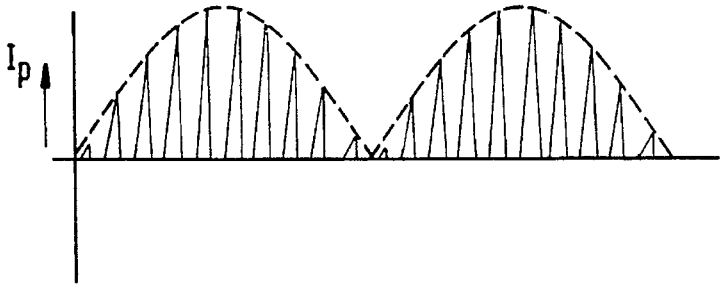

FIG. 4*b* shows the waveform of the first current Ip which flows through the primary winding L1 as a result of the supply voltage and of the alternating conduction and non-conduction of the switching dement Q1. In a practical application, the frequency of the low-frequency supply voltage was approximately 50 Hz, while the frequency with which the switching element Q1 was rendered conducting and non-conducting was approximately 20 kHz. It is apparent that the first current is a pulsatory direct current whose average amplitude has the form of a full-wave rectified sinusoidal current which is in phase with the supply voltage and has a frequency equal to that of the supply voltage. Such a pulsatory current may be realised, for example, in that the duty cycle of the switching element Q1 is made independent of the instantaneous amplitude of the supply voltage. The switching element Q1 in the example shown in FIG. 4 is rendered conducting after the second current has become zero. The power dissipation in the diodes D1 and D2 is limited thereby.

Figure 4C:
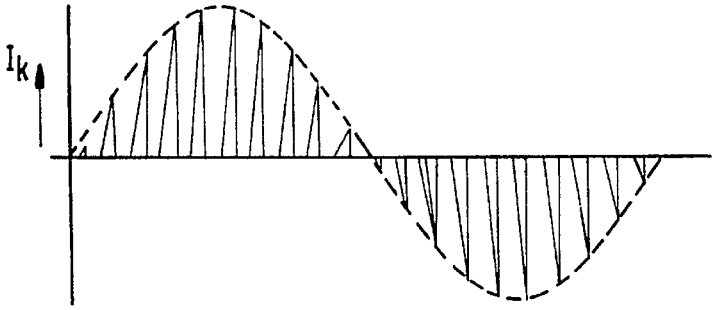

FIG. 4*c* shows the waveform Ik of the non-filtered portion of the lamp current generated from the first current and flowing through supply input terminals K1 and K2. It is apparent that this current is a pulsatory alternating current whose average amplitude has the form of a sinusoidal current in phase with the supply voltage and having a frequency equal to that of the supply voltage. This means that a comparatively high power factor can be achieved by means of a filter (not shown in FIG. 3) in front of the input of the switching device.

Figure 4D:
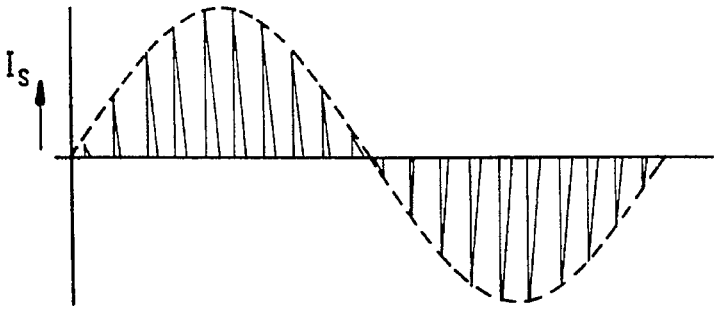

FIG. 4*d* shows the waveform of the second current Is which flows through the secondary winding L2 in the first half cycle of the supply voltage shown, and through the secondary winding L3 in the second half cycle of the supply voltage shown. This current Is is the non-filtered portion of the lamp current generated from the second current. It is apparent that Is is a pulsatory alternating current whose average amplitude has the form of a sinusoidal current which is in phase with the supply voltage and has a frequency equal to that of the supply voltage.

Figure 4E:
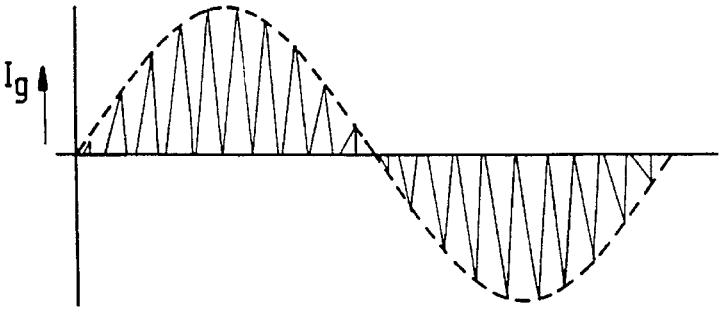

FIG. 4*e* shows the sum of Ik and Is. This sum is also a pulsatory alternating current whose average amplitude has the form of a sinusoidal current in phase with the supply voltage and having a frequency equal to that of the supply voltage. Owing to the action of the filter comprising coil LA and capacitor C3, the filtered total lamp current is a sinusoidal current in phase with the supply voltage and having the same frequency as the supply voltage.

I claim:

1. A circuit arrangement for operating a discharge lamp, comprising:

supply input terminals for connection to a supply voltage source, a transformer having a primary winding and a secondary winding L2, a first branch comprising terminals for holding the lamp and connecting a first end of the secondary winding to a second end of the secondary winding L2, a second branch interconnecting the supply input terminals and comprising a series circuit of a switching element, the terminals for holding the lamp, and the transformer primary winding, and a control circuit coupled to a control electrode of the switching element for generating a control signal for rendering the switching element conducting and non-conducting for thereby generating a first current in the primary winding and a second current in the secondary winding.

2. A circuit arrangement as claimed in claim 1, wherein the first branch further comprises first diode means.

3. A circuit arrangement as claimed in claim 1 further comprising a diode bridge whose input terminals are coupled to one of the terminals for holding the lamp and to a supply input terminal, respectively, and whose output terminals are coupled to a main electrode of the switching element and to an end of the primary winding L1, respectively.

4. A circuit arrangement as claimed in claim 2, further comprising:

a secondary winding L3 forming a part of the transformer, a third branch comprising the terminals for holding the lamp and second diode means which connects a first end of the secondary winding L3 to a second end thereof, switching means included in both the first and the third branch, control means coupled to a control electrode of the switching means for adjusting the conductivity state of the switching means at each change in polarity of a portion of the lamp current generated from the first current such that only one of the secondary windings at a time is conductively connected to the terminals for holding the lamp.

5. A circuit arrangement as claimed in claim 4, wherein the first current operates as the control means.

6. A current arrangement as claimed in claim 1 further comprising a filter for filtering high-frequency components from a current flowing through the lamp.

7. A circuit arrangement as claimed in claim 2, wherein the switching element, the transformer, and the diode means form part of a DC—DC converter of the flyback type and wherein said first and second currents flow through the discharge lamp as alternating currents while flowing through the primary winding and the secondary Winding, respectively, as unidirectional currents.

8. A circuit arrangement as claimed in claim 1, wherein the number of turns of the secondary winding is equal to 30%–70% of the number of turns of the primary winding.

9. A circuit arrangement as claimed in claim 1 further comprising a control loop coupled to the control circuit for controlling the power consumed by the lamp.

10. A current arrangement as claimed in claim 2, wherein the circuit arrangement is dimensioned such that the control signal renders the switching element conducting when the second current is zero.

11. A circuit arrangement as claimed in claim 2, further comprising a diode bridge having input terminals coupled to one of the terminals for holding the lamp and to a supply input terminal, respectively, and having output terminals coupled to a main electrode of the switching element and to an end of the primary winding L1, respectively.

12. A circuit arrangement as claimed in claim 3, further comprising:

a secondary winding L3 forming a part of the transformer, a third branch comprising the terminals for holding the lamp and second diode means and which connects a first end of the secondary winding L3 to a second end of the secondary winding L3, switching means included in both the first and the third branch, control means coupled to a control electrode of the switching means for adjusting the conductivity state of the switching means at each change in polarity of a portion of the lamp current generated from the first current such that only one of the secondary windings at a time is conductively connected to the terminals for holding the lamp.

13. A circuit arrangement as claimed in claim 11, further comprising:

a secondary winding L3 forming a part of the transformer, a third branch comprising the terminals for holding the lamp and second diode means and which connects a first end of the secondary winding L3 to a second end of the secondary winding L3, switching means included in both the first and the third branch, control means coupled to a control electrode of the switching means for adjusting the conductivity state of the switching means at each change in polarity of a portion of the lamp current generated from the first current such that only one of the secondary windings at a time is conductively connected to the terminals for holding the lamp.

14. The discharge lamp operating circuit as claimed in claim 1 wherein said first and second currents flow through the discharge lamp as synchronized alternating currents.

15. A circuit arrangement as claimed in claim 3, provided with a filter for filtering high-frequency components from a current flowing through the lamp.

16. A circuit arrangement as claimed in claim 4, provided with a filter for filtering high-frequency components from a current flowing through the lamp.

17. A circuit arrangement as claimed in claim 5, provided with a filter for filtering high-frequency components from a current flowing through the lamp.

18. A circuit arrangement as claimed in claim 3, wherein the switching element, the transformer, and the diode means form part of a DC—DC converter of the flyback type.

19. A circuit arrangement as claimed in claim 4, wherein the switching element, the transformer, and the diode means form part of a DC—DC converter of the flyback type.

20. A circuit arrangement as claimed in claim 5, wherein the switching element, the transformer, and the diode means form part of a DC—DC converter of the flyback type.

21. A circuit arrangement as claimed in claim 2, wherein the number of turns of the secondary winding is equal to 30%–70% of the number of turns of the primary winding.

22. A circuit arrangement as claimed in claim 3, wherein the number of turns of the secondary winding is equal to 30%–70% of the number of turns of the primary winding.

23. A circuit arrangement as claimed in claim 2, further comprising a control loop coupled to the control circuit for controlling the power consumed by the lamp.

24. A circuit arrangement as claimed in claim 3, further comprising a control loop coupled to the control circuit for controlling the power consumed by the lamp.

25. A circuit arrangement as claimed in claim 3, wherein the circuit arrangement is dimensioned such that the control signal renders the switching element conducting when the second current is zero.

26. A circuit arrangement as claimed in claim 11, wherein the circuit arrangement is dimensioned such that the control signal renders the switching element conducting when the second current is zero.

27. A circuit for operating a discharge lamp comprising:

first and second input terminals for connection to a source of supply voltage, a transformer having a primary winding and secondary winding means, first and second output terminals for connection to the discharge lamp, a first branch circuit including said first and second output terminals coupled to first and second terminals of the secondary winding means, a second branch circuit connected to said first and second input terminals and comprising a series circuit including a controlled switching element, the transformer primary winding and said first and second output terminals, and a control circuit coupled to a control electrode of the controlled switching element for generating a control signal that turns the switching element on and off whereby a first current flows in the primary winding and a second current flows in the secondary winding means such that a current flows through the discharge lamp that is composed of said first and second currents.

28. The discharge lamp operating circuit as claimed in claim 27 further comprising a second controlled switching element connected in series circuit with the first and second output terminals in the first branch circuit and switched on and off such that the second current will flow in phase with the first current through the output terminals when a discharge lamp is connected thereto.

29. The discharge lamp operating circuit as claimed in claim 27 wherein the first branch circuit further comprises a first diode connected in series circuit with the first and second output terminals.

30. The discharge lamp operating circuit as claimed in claim 27 wherein the supply voltage is an AC voltage, and further comprising a rectifier circuit coupled to said input terminals, said output terminals and said second branch circuit such that the current which flows through the discharge lamp is an alternating current and said first current is a pulsatory type direct current.

31. The discharge lamp operating circuit as claimed in claim 30 wherein said rectifier circuit is included in the second branch circuit in series with the primary winding, the controlled switching element and the first and second output terminals.

32. The discharge lamp operating circuit as claimed in claim 27 wherein the first branch circuit further comprises diode means and a second controlled switching element connected in series circuit with the first and second output terminals and switched on and off such that the first and second currents comprise a pulsatory type DC current and an alternating current, respectively, which are in synchronism.

33. The discharge lamp operating circuit as claimed in claim 27 wherein the secondary winding means comprises first and second windings with said first branch circuit coupled to the first winding, said circuit further comprising:

a third branch circuit coupled to the second winding and including the first and second output terminals, and a controlled switching means connected to both the first and third branch circuits and turned on and off such that currents alternately flow from the first and second windings through the first and second output terminals via the first and third branch circuits, respectively, and the controlled switching means.

34. The discharge lamp operating circuit as claimed in claim 33 wherein the controlled switching means is directly controlled by the first current.

35. The discharge lamp operating circuit as claimed in claim 27 wherein the supply voltage is a low frequency AC voltage and the control signal is a high-frequency signal.

* * * * *